United States Patent [19]

Matsumura et al.

[11] Patent Number: 4,551,874

[45] Date of Patent: Nov. 12, 1985

[54] PNEUMATIC MASSAGE MAT

[75] Inventors: Mitsuma Matsumura; Tadahisa Mogaki; Toshio Mikiya, all of Tokyo, Japan

[73] Assignee: Nitto Kohki Co., Ltd., Tokyo, Japan

[21] Appl. No.: 450,388

[22] Filed: Dec. 16, 1982

[51] Int. Cl.[4] ..... A61H 9/00; A61G 7/04

[52] U.S. Cl. ..... 5/453; 5/455; 5/457; 5/446

[58] Field of Search ..... 5/446, 448, 449, 451, 5/453–456, 457; 128/33

[56] References Cited

U.S. PATENT DOCUMENTS

| | | | |
|---|---|---|---|
| 2,245,909 | 6/1941 | Enfiajian | 5/455 |
| 3,026,541 | 3/1962 | Murat | 5/453 |
| 3,199,124 | 8/1965 | Grant | 5/453 |
| 3,595,223 | 7/1971 | Castanaga | 5/457 |
| 3,701,173 | 10/1972 | Whitney | 128/33 |
| 4,391,009 | 7/1983 | Schild et al. | 5/455 |

FOREIGN PATENT DOCUMENTS

| | | | |
|---|---|---|---|
| 137313 | 12/1902 | Fed. Rep. of Germany | 5/455 |

*Primary Examiner*—Gary L. Smith
*Assistant Examiner*—Michael F. Trettel
*Attorney, Agent, or Firm*—Thomas H. Murray

[57] ABSTRACT

A pneumatic massage mat comprises a plurality of juxtaposed air chambers which are expanded and contracted in given sequence by sequentially feeding and bleeding air under pressure into and out of the respective chambers. The air space of each said air chamber is narrowed in the width direction at a substantially central portion and opposed end portions with respect to the longitudinal direction of the chamber such that these narrow portions are filled with a smaller volume of air than the remaining portions.

3 Claims, 9 Drawing Figures

PNEUMATIC MASSAGE MAT

BACKGROUND OF THE INVENTION

This invention relates to a pneumatic massage mat for the pneumatic massage of any desired regions of the human body lying supine or prone on the mat.

Pneumatic massage equipment use a pneumatically expandable/contractable air bag which is placed on the floor and discontinuously expanded and contracted with the human body lying thereon. Air under pressure is fed into and bled from air chambers defined in the air bag in given sequence to expand and contract the air bag to thereby apply local pressure to the body for massage.

Since an air bag is expanded such that air chambers are most bulged at their central portion, the body lying on the bag becomes unstable. Moreover, in case of supine lying, the pressure force is concentrated to a region straight above the spine and is not applied to those effective spots located in series on opposite sides of the spine, failing to provide appropriate and effective massage. Since the opposed side portions of the air bag impart a less pressure force to the body when expanded, the supply of compressed air to the side portions is wasteful.

SUMMARY OF THE INVENTION

This invention is made to eliminate the above-mentioned shortcomings, and its object is to provide a pneumatic massage mat in which the air space of each air chamber is narrowed in the width direction at a central portion and opposed end portions such that pneumatic massaging motion is effectively and steadily applied to any appropriate regions of the lying body by making the best use of the pneumatic pressure supplied. More specifically, the pneumatic massage mat of this invention is capable of applying comfortable soft massaging motion to substantially all the regions of the body including legs, waist, back, neck, belly, and breast.

BRIEF DESCRIPTION OF THE DRAWINGS

This invention will be further described by referring to the embodiments shown in the drawings, in which.

PREFERRED EMBODIMENT OF THE INVENTION

Figure 1:
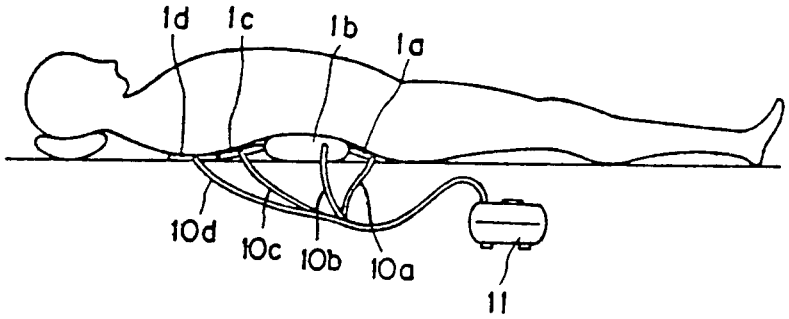
FIG. 1 illustrates how to use a pneumatic massage equipment with which the pneumatic massage mat of this invention is combined.
Figure 2:
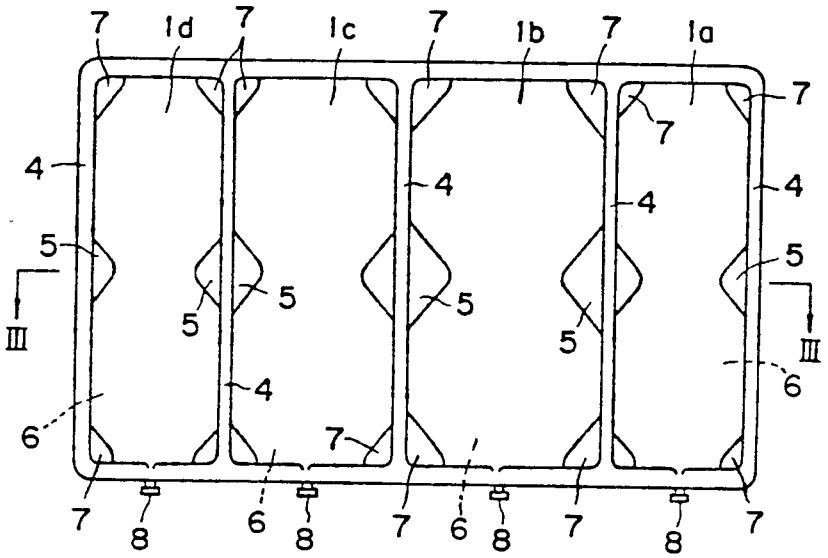
FIGS. 2 and 3 are plan and cross-sectional views of the pneumatic massage mat of this invention.
Figure 3:
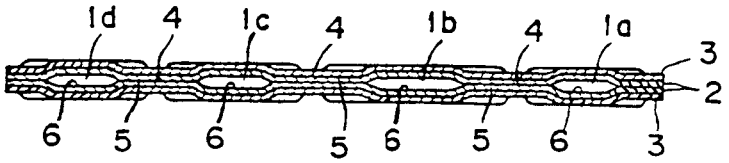

Numeral 1 designates a pneumatic massage mat (to be simply referred to as "mat", hereinafter) in the form of an air bag which may be expanded by supplying air under pressure. The mat 1 comprises a pair of expandable air-impermeable face and back sheets 2 and 2 and a pair of flexible, but less expandable face and back covers 3 and 3 which are sealed along their edges to form a substantially flat air-tight bag. The air bag is divided into a plurality of substantially rectangular independent air chambers, for example, four air chambers 1*a*, 1*b*, 1*c*, and 1*d* as shown in the drawings. In the illustrated embodiment, the second air chamber 1*b* is the widest, the third air chamber 1*c* is narrower than the second chamber 1*b*, and the first and fourth air chambers 1*a* and 1*d* are slightly narrower than the third chamber 1*c*.

Numeral 4 designates air-tight seals formed to define the air chambers 1*a* to 1*d*. An air space 6 of each of the air chambers 1*a* to 1*d* is narrowed in width at a substantially central portion with respect to the longitudinal direction of the chamber by means of air-tight seals 5 between the face and the back sheets. The air space 6 is also narrowed in width at opposed end portions with respect to the longitudinal direction of the chamber by means of air-tight seals 7 between the face and the back sheets. The seals 5 formed at the central portion are of a triangular configuration with the apex directed to the center of the air space. The adjoining seals 5 of the adjoining air chambers, for example, the first and second air chambers 1*a* and 1*b* substantially form a rhombus, and the adjoining seals 7 of the adjoining air chambers, for example, the first and second air chambers 1*a* and 1*b* substantially form a triangle.

Each of the air chambers 1*a* to 1*d* is provided at one end with a feed/bleed conduit 8 extending longitudinally from one end of the chamber for feeding and bleeding air under pressure.

Figure 4A:
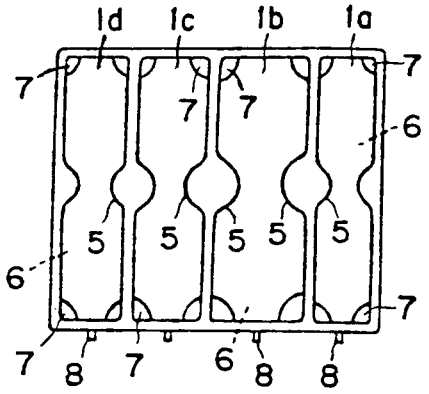
FIGS. 4A to 4F are plan views showing six different embodiments of the pneumatic massage mat of this invention.
Figure 4B:
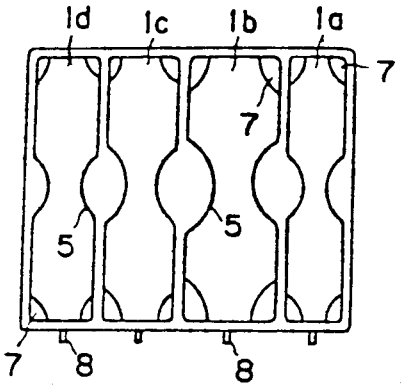
Figure 4C:
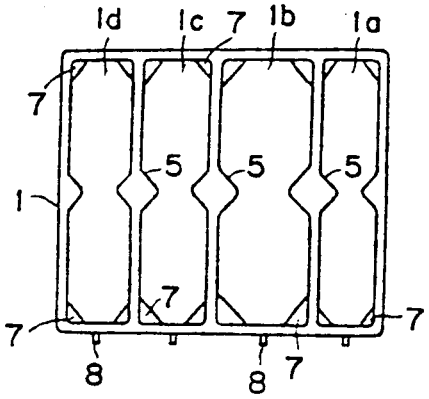
Figure 4D:
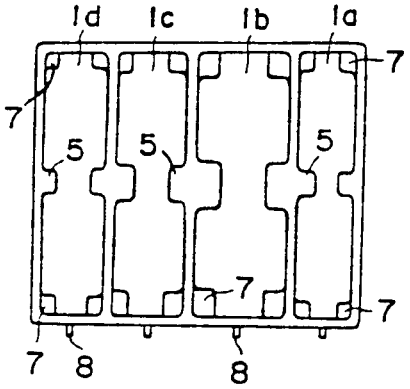
Figure 4E:
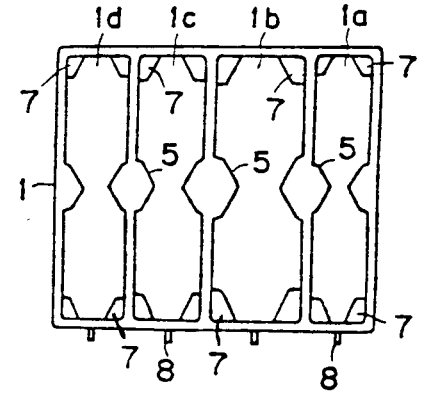
Figure 4F:
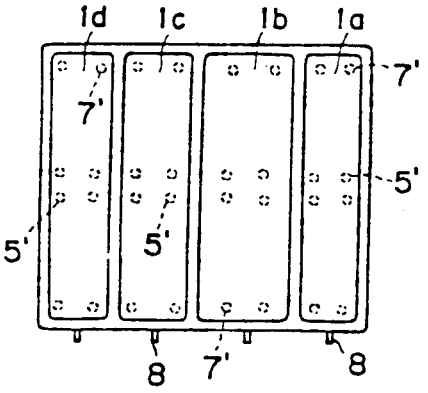

FIGS. 4A to 4F illustrate other embodiments of the mat in which the configurations of the seals 5 and 7 are different from those of the above-mentioned embodiment. The seals 5 and 7 for narrowing the air spaces 6 are semi-circular in FIG. 4A, semi-ellipsoidal in FIG. 4B, of a rectangular equilateral triangle in FIG. 4C, rectangular in FIG. 4D, and of a roof configuration having a gentle grade in FIG. 4E. The seals 5 and 7 may also take the form of local sealing spots as shown in FIG. 4F.

Since the first and fourth air chambers 1*a* and 1*d* are the same and the minimum in size, the third air chamber 1*c* is intermediate, and the second air chamber 1*b* is the maximum in size in the mat 1 shown in FIGS. 4A to 4F, the air spaces 6 are correspondingly narrowed, that is, the first and fourth air chambers 1*a* and 1*d* are narrowed to the least extent and the remaining air chamber 1*b* and 1*c* are provided with seals of sizes proportional to the volume of the respective chambers. In FIG. 4A, for example, the semi-circular seals 5 formed to narrow the air space 6 at the central portion have the largest radius in the second air chamber 1*b*, are reduced in radius in the third and first air chambers 1*c* and 1*a* in this order, with the semi-circular seals 5 in the fourth air chamber 1*d* having the same radius as in the first air chamber 1*a*.

Upon practical use of the mat 1 of the above arrangement, the conduits 8 communicating with the air chambers 1*a* to 1*d* defined in the mat 1 are connected to the free ends of feed/bleed tubes 10*a*, 10*b*, 10*c*, and 10*d* whose other ends are connected to a source of air 11 including a compressor as shown in FIG. 1. Then, the user lies supine on the mat 1 with the lumbar vertebra positioned on the second air chamber 1*b*, the hip on the first air chamber 1*a*, and the back on the third and fourth air chambers 1*c* and 1*d*. In this condition, air under pressure is supplied to the first, second, third and fourth air chambers in a sequential cycle from the air source 11 through the tubes 10*a*, 10*b*, 10*c*, and 10*d*. The air chambers are sequentially expanded from the first air chamber 1*a* to the fourth air chamber 1*d*. When expanded, the first air chamber 1*a* applies pressure to the hip, the second air chamber 1*b* which expands more than the first chamber 1*a* applies more pressure to the waist, and the third air chamber 1*c* which expands less than the second chamber 1*b* applies moderate pressure to the back. Since the air chambers 1*a* to 1*d* are narrowed at the central portion, pneumatic pressure is applied to the opposed regions outside the spine. In addition, since the air spaces 6 are narrowed at the end portions, the air fed into the air chambers is effectively used to enhance the pressure force.

In the pneumatic massage mat of this invention in which the air space of each of juxtaposed air chambers is narrowed at a central portion and opposed end portions, effective massaging pressure is steadily applied to appropriate regions of the body lying on the mat. Since the air chambers are narrowed at their opposed end portions, the air under pressure introduced in the air chambers imparts a more pneumatic pressure to the body, achieving proper massaging effect.

What is claimed is:

1. A pneumatic massage mat comprising:

a plurality of elongated air chambers which are juxtaposed such that, upon being expanded and contracted in given sequence by sequentially feeding and bleeding air under pressure into and out of the respective chambers, said massage mat imparts a massaging action to the body of the user, wherein the air space of each said air chamber is narrowed in width at a substantially central portion and at opposed end portions thereof with respect to the longitudinal extent of the chamber such that these narrow portions are filled with a smaller volume of air than the remaining portions, and wherein the central narrowed portions of the juxtaposed air chambers extend along substantially a straight line and along the spine of the user.

2. The pneumatic massage mat of claim 1, wherein said air chambers are formed from flexible and expandable sheets.

3. The pneumatic massage mat of claim 1, wherein said air chambers are generally rectangular.

* * * * *